US008585239B1

(12) United States Patent
Tseng

(10) Patent No.: US 8,585,239 B1
(45) Date of Patent: Nov. 19, 2013

(54) OPTICAL LENS AND LIGHT SOURCE MODULE HAVING THE SAME

(71) Applicant: Yung-Chang Tseng, New Taipei (TW)

(72) Inventor: Yung-Chang Tseng, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/662,577

(22) Filed: Oct. 29, 2012

(30) Foreign Application Priority Data

Oct. 19, 2012 (TW) ..... 101138744 A

(51) Int. Cl.
*F21V 5/00* (2006.01)

(52) U.S. Cl.
USPC ..... 362/244; 362/311.01; 362/329

(58) Field of Classification Search
USPC ..... 362/244, 249.01, 249.02, 311.01, 362/311.02, 308, 309, 326–329, 335; 257/98–100, E33.059, E33.073; 349/61, 62
See application file for complete search history.

(56) References Cited

U.S. PATENT DOCUMENTS

| | | | | |
|---|---|---|---|---|
| 7,111,964 | B2 * | 9/2006 | Suehiro et al. | 362/328 |
| 7,422,347 | B2 * | 9/2008 | Miyairi et al. | 362/335 |
| 7,602,559 | B2 * | 10/2009 | Jang et al. | 359/726 |
| 7,621,657 | B2 * | 11/2009 | Ohkawa | 362/311.01 |
| 7,766,530 | B2 * | 8/2010 | Hwang et al. | 362/613 |
| 7,866,844 | B2 * | 1/2011 | Yamaguchi | 362/244 |
| 7,880,188 | B2 * | 2/2011 | Blumel et al. | 257/98 |
| 7,959,328 | B2 * | 6/2011 | Wanninger | 362/309 |
| 7,963,680 | B2 * | 6/2011 | Yoon et al. | 362/336 |
| 8,052,307 | B2 * | 11/2011 | Bak et al. | 362/257 |
| 8,075,157 | B2 * | 12/2011 | Zhang et al. | 362/249.02 |
| 8,147,100 | B2 * | 4/2012 | Yamaguchi | 362/311.02 |
| 8,213,093 | B2 * | 7/2012 | Bak et al. | 359/718 |
| 8,220,958 | B2 * | 7/2012 | Montagne | 362/235 |
| 8,508,688 | B2 * | 8/2013 | Iiyama et al. | 349/61 |
| 2006/0198144 | A1 * | 9/2006 | Miyairi et al. | 362/257 |
| 2011/0228528 | A1 * | 9/2011 | Yang et al. | 362/235 |

* cited by examiner

*Primary Examiner* — Hargobind S Sawhney
(74) *Attorney, Agent, or Firm* — Altis & Wispro Law Group, Inc.

(57) ABSTRACT

A lens for covering a light source to diverge light from the light source includes a first curved surface facing the light source, a second curved surface covering the first curved surface, and a connecting surface interconnecting bottoms of the first curved surface and the second curved surface. A plurality of first protrusions and second protrusions are formed on the connecting surface. The first protrusions and the second protrusions each are semi-terete. The first protrusions are parallel to and spaced from each other. The second protrusions are parallel to and spaced from each other. The first protrusions intersect the second protrusions.

18 Claims, 3 Drawing Sheets

OPTICAL LENS AND LIGHT SOURCE MODULE HAVING THE SAME

BACKGROUND

1. Technical Field

The present disclosure generally relates to optical devices, and particularly to an optical lens and a light source module which has the optical lens.

2. Description of Related Art

In recent years, thanks to excellent light quality and high luminous efficiency, light emitting diodes (LEDs) have increasingly been used as substitutes for incandescent bulbs, compact fluorescent lamps and fluorescent tubes as light sources of illumination devices.

Generally, a conventional light source module includes a lens covered on the light source to adjust an angular distribution of the light radiated from the light source. A conventional lens includes two curved surfaces, a small curved surface adjacent to the light source and a big curved surface away from the light source. The big curved surface covers the small curved surface therein. A bottom surface connects bottoms of the big curved surface and the small surface. The bottom surface is flattened. However, part of light passing in the lens strikes on the bottom surface and is reflected to some regular directions, which results in a small light field.

Therefore, it is necessary to provide an optical lens and a light source module to overcome the above-mentioned shortcomings.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure.

DETAILED DESCRIPTION

Reference will now be made to the drawings to describe an exemplary embodiment of the present optical lens and the light source module having the same.

Figure 1:
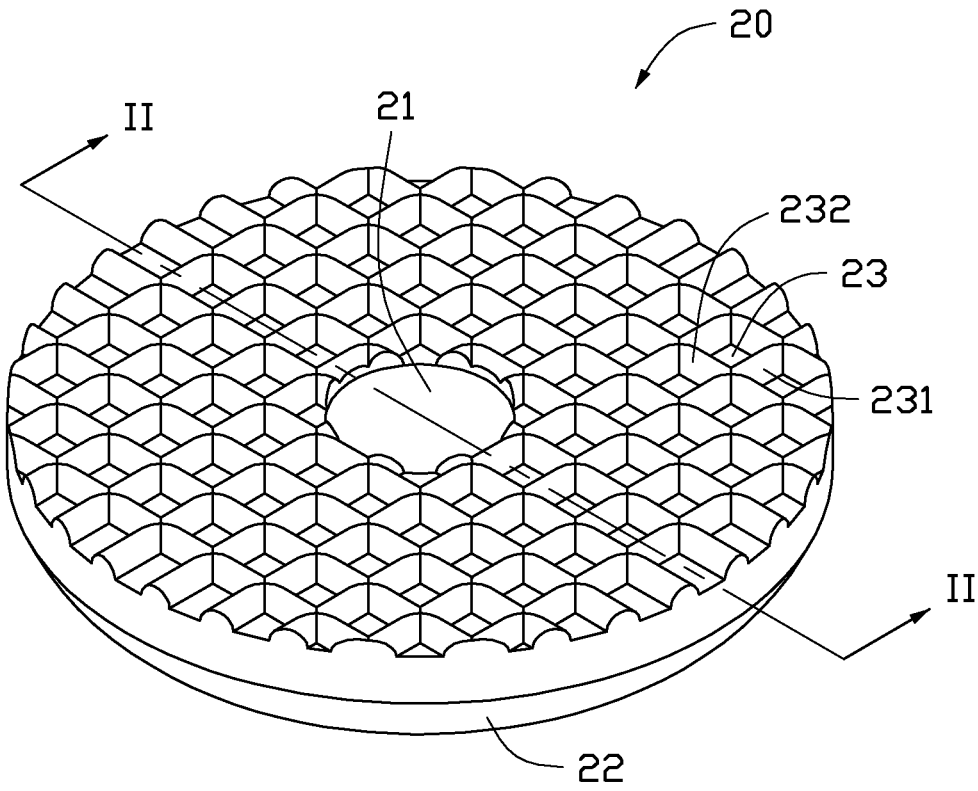
FIG. 1 is a schematic, isometric view of an optical lens in accordance with an exemplary embodiment of the present disclosure.
Figure 2:
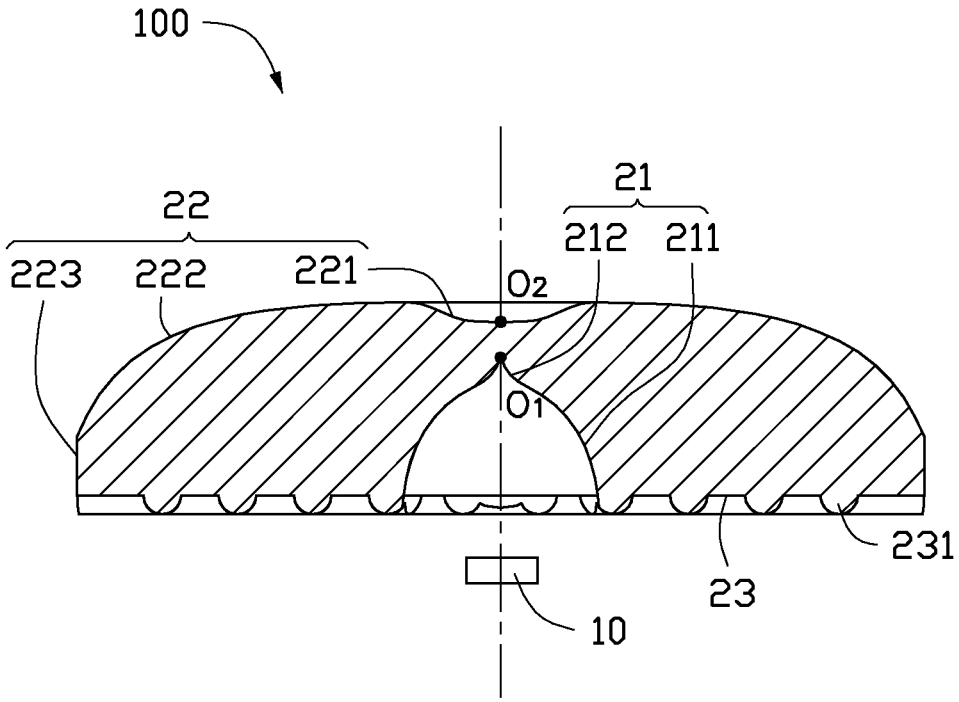
FIG. 2 is a cross-sectional view of a light source device in accordance with an exemplary embodiment of the present disclosure having the optical lens of FIG. 1 and a light source, the cross-sectional view taken along line II-II of FIG. 1.

Referring to FIG. 1 and FIG. 2, a light source module 100, in accordance with an exemplary embodiment of the present disclosure, includes a light source 10 and an optical lens 20 located on the light source 10. In this embodiment, the light source 10 is an LED.

The lens 20 includes a first curved surface 21, a second curved surface 22 and a connecting surface 23 interconnected the first and second curved surfaces 21, 22. The second curved surface 22 covers the first curved surface 21. Bottoms of both the first and second curved surfaces 21, 22 are interconnected by the connecting surface 23.

The first curved surface 21 covers the light source 10. The first curved surface 21 includes a bottom portion 211 and a top portion 212. In this embodiment, a contour profile of the bottom portion 211 is substantially an ellipsoid. The top portion 212 further recesses upwardly into the lens 20 from a top of the bottom portion 211. A slope of the cross-section of the bottom portion 211 decreases along a direction from the connecting surface 23 to the top portion 212. A slope of the cross-section of the top portion 212 increases along a direction from the bottom portion 211 to a top point of the top portion 212. A top point O1 is the top point of the top portion 212 which is positioned on an optical axis of the lens 20 and a central axis of the light source 10. A bottom periphery of the first curved surface 21 is positioned on the connecting surface 23. In other words, a bottom edge of the bottom portion 211 is positioned on the connecting surface 23. The top portion 212 is used for diverging light radiated from the light source 10. When the light radiated from the light source 10 strikes on the first curved surface 21, part of the light at a center portion travels through the top portion 212 and is refracted to lateral sides of the lens 20 to diverge the light from the center portion to lateral sides of the lens 20.

The second curved surface 22 is positioned on the first curved surface 21. A center point O2 of the second curved surface 22 is directly on the optical axis of the lens 20 and the central axis of the light source 10. The second curved surface 22 includes a concave surface 221 at a top center portion of the lens 20, an arcuate surface 222 at a periphery side of the concave surface 221, and an annual side surface 223 around lateral sides of the lens 20. The arcuate surface 222 interconnects the concave surface 221 and the annual side surface 223. The concave surface 221 is located above the top point O1 of the first curved surface 21 and the light source 10. The concave surface 221 can be a concave circle surface recessed downwardly into the lens 20 to further diverge the light traveled through the concave surface 221. The arcuate surface 222 protrudes away from the light source 10. A radius of curvature of the arcuate surface 222 is greater than that of the concave surface 221. Bottom periphery sides of both the first and second curved surfaces 21, 22 are positioned on the connecting surface 23 and are interconnected by the connecting surface 23.

A plurality of protruding bars are interlaced formed on the connecting surface 23. The protruding bars protrude downwardly from the connecting surface 23 and away from the concave surface 221 of the second curved surface 22. The protruding bars include a plurality of first protrusions 231 and a plurality of second protrusions 232. The first protrusions 231 are parallel to and spaced from each other, and the second protrusions 232 are parallel to and spaced from each other. A shape of each first protrusion 231 is the same as that of the second protrusions 232. Both the first protrusion 231 and the second protrusion 232 are semi-terete. Take one first protrusion 231 for example, a shape of cross-section of the first protrusion 231 is a semi-circle. A centre of the semi-circle is located on the connecting surface 23. A radius of the semi-circular first protrusion 231 is 0.1 millimeter (mm). In other words, a distance between a point on the first protrusion 231 protruded farthest from the connecting surface 23 and the connecting surface 23 is 0.1 mm. The first protrusions 231 are arranged on the connecting surface 23 in linear array with an interval of 0.6 mm between two adjacent first protrusions 231. In other words, a distance between the centers of each two adjacent first protrusions 231 is 0.6 mm. In this embodiment, the second protrusions 232 are parallel to each other and vertically intersect the first protrusions 231. A distance between the centers of each two adjacent second protrusions 232 is 0.6 mm. The first protrusions 231 and the second protrusions 232 are interlaced with each other to present a "#" shape.

When light radiated from the light source 10 passes through the lens 20, part of the light travels in the lens 20 and strikes on the first protrusions 231 and the second protrusions 232. The light strikes on the semicircular first and second protrusions 231, 232 with different incident angles. Each point of the first and second protrusions 231, 232 has different tangents. Thus, the light is reflected by the first protrusions 231 and the second protrusions 232 to different directions to increase outputting angles of the light and distribute the light evenly.

Figure 3:
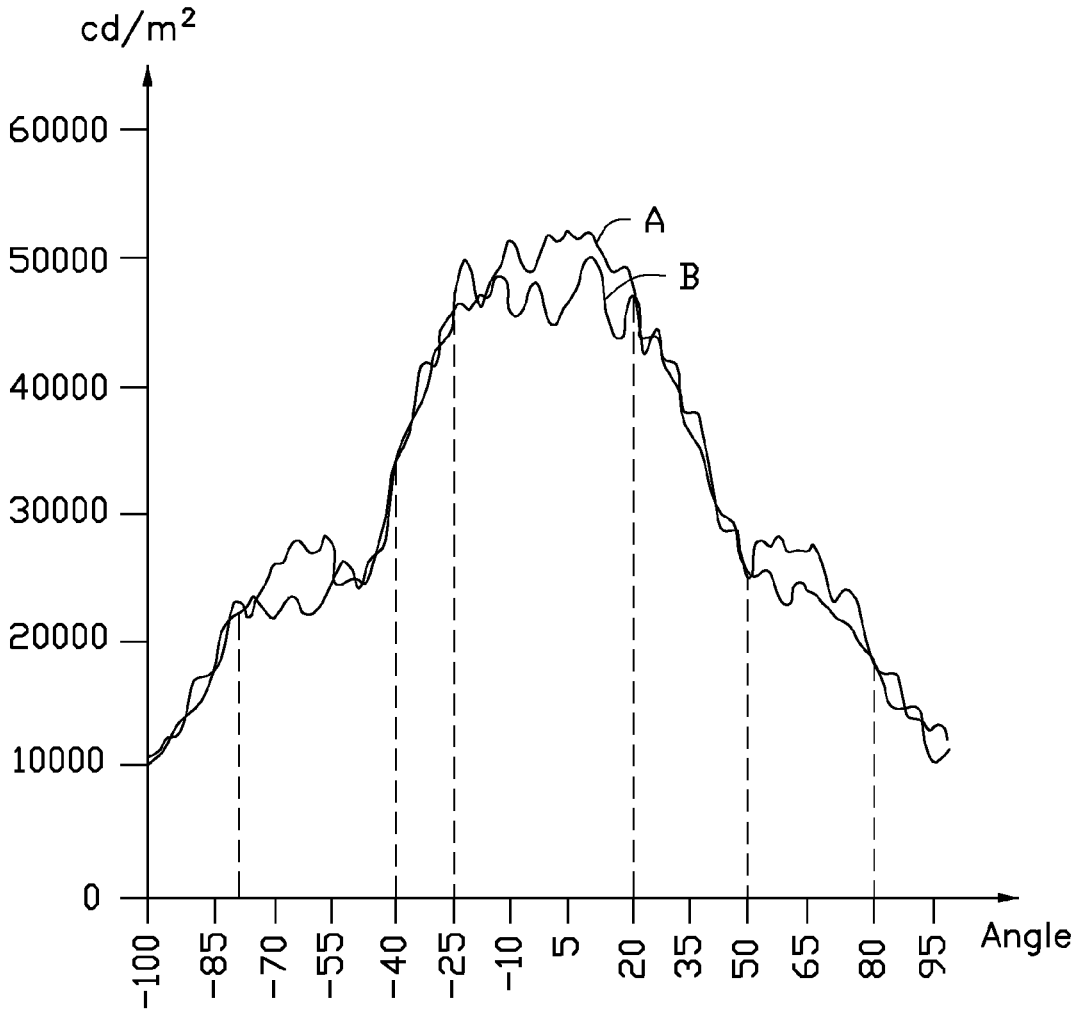
FIG. 3 is a coordinate graph showing a light luminance distribution of the light source device having the optical lens of FIG. 2.

Referring to FIG. 3, a graph having a curve A indicating a light luminance (vertical) versus a light angle (horizon) of the light source module 100 and a curve B indicating a light luminance (vertical) versus a light angle (horizon) of a conventional light source module is shown. The highest luminance of curve A occurs from −25 degrees to 20 degrees which is lower than that of curve B. A comparative lower luminance of curve A occurs from −80 degrees to −40 degrees and from 50 degrees to 80 degrees which is higher than that of curve B. A difference between the value of the highest luminance and the lower luminance of the present disclosure is smaller than that in a conventional light source module, which proves that the light source module 100 having the optical lens 20 can distribute light in a large light field evenly. Further, during operating, the luminance value of the optical lens 20 having the protrusions on the connecting surface 23 at a position 30 millimeters away from the light source 100 is 10% lower than that of the conventional lens without any protrusions formed. A difference between the light traveling at the centre portion and the periphery sides of the lens is also decreased in comparison with the conventional lens.

It is to be understood that the above-described embodiments are intended to illustrate rather than limit the disclosure. Variations may be made to the embodiments without departing from the spirit of the disclosure as claimed. The above-described embodiments illustrate the scope of the disclosure but do not restrict the scope of the disclosure.

What is claimed is:

1. A lens for covering a light source to diverge light radiated from the light source, the lens comprising:

a first curved surface facing the light source;

a second curved surface covering the first curved surface;

a connecting surface interconnecting bottoms of the first curved surface and the second curved surface; and a plurality of first protrusions and second protrusions formed on the connecting surface, the first protrusions and the second protrusions each being semi-terete, the first protrusions being parallel to and spaced from each other, the second protrusions being parallel to and spaced from each other, the first protrusions intersecting the second protrusions.

2. The lens of claim 1, wherein a radial cross section of each first protrusion is a semi-circle with a radius of 0.1 mm.

3. The lens of claim 1, wherein a center of each first protrusion is located on the connecting surface.

4. The lens of claim 1, wherein a distance between two adjacent first protrusions is 0.6 mm.

5. The lens of claim 1, wherein a distance between the connecting surface and a point on the first protrusions protruded farthest from the connecting surface is 0.1 mm.

6. The lens of claim 1, wherein the first protrusions and the second protrusions are the same in configuration.

7. The lens of claim 6, wherein a distance between each two adjacent second protrusions is 0.6 mm.

8. The lens of claim 1, wherein the first protrusions intersect the second first protrusions vertically.

9. The lens of claim 1, wherein the first curved surface comprises a bottom portion recessing into the lens and a top portion further recessing into the lens from a top of the bottom portion, a slope of the cross-section of the bottom portion decreasing from the connecting surface to the top portion, and a slope of the cross-section of the top portion increasing from the bottom portion to a top of the top portion.

10. The lens of claim 1, wherein the second curved surface comprises a concave surface at a top center portion of the lens, an arcuate surface at a periphery side of the concave surface, and an annual side surface around lateral sides of the lens.

11. A lens for covering a light source to diverge light radiated from the light source, the lens comprising:

a first curved surface for incidence of the light;

a second curved surface for extracting of the light;

a connecting surface connecting the first and second curved surfaces and positioning adjacent to the light source;

a plurality of first protrusions and second protrusions protruding from the connecting surface towards the light source, the first protrusions being parallel to and spaced from each other, the second protrusions being parallel to and spaced from each other, and the first protrusions intersecting the second protrusions.

12. The lens of claim 11, wherein the first protrusions and the second protrusions each are semi-terete.

13. A light source module comprising:

a light source;

a first curved surface facing the light source;

a second curved surface covering the first curved surface;

a connecting surface interconnecting bottoms of the first curved surface and the second curved surface; and a plurality of first protrusions and second protrusions formed on the connecting surface, the first protrusions and the second protrusions each being semi-terete, the first protrusions being parallel to and spaced from each other, the second protrusions being parallel to and spaced from each other, the first protrusions intersecting the second protrusions.

14. The light source module of claim 13, wherein the light source is an LED light source.

15. The light source module of claim 13, wherein a radial cross section of each first protrusion is a semi-circle with a radius of 0.1 mm.

16. The light source module of claim 13, wherein a center of each first protrusion is located on the connecting surface.

17. The light source module of claim 16, wherein a distance between each two adjacent first protrusions is 0.6 mm.

18. The light source module of claim 13, the first protrusions and the second protrusions are the same in configuration.

* * * * *